US007655113B2

(12) United States Patent
Slaghek et al.

(10) Patent No.: US 7,655,113 B2
(45) Date of Patent: Feb. 2, 2010

(54) MIXING OF A PROTEIN HYDROLYSATE DERIVED FROM KERATIN-CONTAINING MATERIAL IN THE WET-END OF A PAPERMAKING PROCESS

(75) Inventors: Theodoor M. Slaghek, Rotterdam (NL); Mario T. R. van Wandelen, Zeist (NL); Willem C. Drost, Zeist (NL); Dario M. R. Lo Cascio, Ouderkerk aan de Amstel (NL); Remco W. G. van Willige, Apeldoorn (NL)

(73) Assignee: Nederlandse Organisatie Voor Toegepastnatuurwetenschappelijk Onderzoek Tno, Delft (NL)

( * ) Notice: Subject to any disclaimer, the term of this patent is extended or adjusted under 35 U.S.C. 154(b) by 155 days.

(21) Appl. No.: 10/589,868

(22) PCT Filed: Feb. 18, 2005

(86) PCT No.: PCT/NL2005/000120

§ 371 (c)(1),
(2), (4) Date: Oct. 19, 2006

(87) PCT Pub. No.: WO2005/080680

PCT Pub. Date: Sep. 1, 2005

(65) Prior Publication Data

US 2007/0151686 A1 Jul. 5, 2007

(30) Foreign Application Priority Data

Feb. 19, 2004 (EP) ..... 04075539

(51) Int. Cl.
*D21H 17/22* (2006.01)

(52) U.S. Cl. ..... 162/174; 162/143; 162/151; 530/357

(58) Field of Classification Search ..... 162/2, 162/143, 151, 174; 530/357; 8/517
See application file for complete search history.

(56) References Cited

U.S. PATENT DOCUMENTS

| | | | | |
|---|---|---|---|---|
| 3,207,613 | A | 9/1965 | Merrill et al. | |
| 4,184,914 | A * | 1/1980 | Jenkins | 162/135 |
| 4,591,497 | A * | 5/1986 | Naito et al. | 424/43 |
| 5,316,942 | A | 5/1994 | Fink | |
| 5,707,491 | A * | 1/1998 | Hughes et al. | 162/143 |
| 5,810,970 | A | 9/1998 | Hughes et al. | |
| 6,120,644 | A * | 9/2000 | Schroeder et al. | 162/158 |
| 6,296,860 | B1 * | 10/2001 | Hasegawa et al. | 424/401 |
| 6,500,443 | B1 * | 12/2002 | Otts et al. | 424/402 |
| 2008/0207867 | A1 * | 8/2008 | Uehara et al. | 528/271 |

FOREIGN PATENT DOCUMENTS

CN 1063874 A 8/1992

(Continued)

OTHER PUBLICATIONS

International Search Report for PCT/NL2005/000120 dated Jun. 21, 2005.

(Continued)

*Primary Examiner*—Eric Hug
*Assistant Examiner*—Anthony J Calandra
(74) *Attorney, Agent, or Firm*—Nixon & Vanderhye P.C.

(57) ABSTRACT

A process for producing a protein hydrolysate derived from keratin containing material with an oxidative bleaching agent at an acidic pH and mixing the keratin hydrolysate as an additive to the wet-end of a papermaking process. The process achieves a paper with a lower porosity and greater breaking length.

9 Claims, 5 Drawing Sheets

FOREIGN PATENT DOCUMENTS

| | | | |
|---|---|---|---|
| CN | 1112368 | A | 11/1995 |
| WO | 99/13861 | | 3/1999 |
| WO | WO 03/006531 | A1 * | 1/2003 |

OTHER PUBLICATIONS

Patent Abstracts of Japan, vol. 018, No. 547 (C-1262) Oct. 19, 1994 and JP 06 192433, Jul. 12, 1994.
Patent Abstracts of Japan, vol. 2003, No. 12, Dec. 5, 2003 and JP 2003 238330, Aug. 27, 2003.
Patent Abstracts of Japan, vol. 018, No. 542 (C-1261) Oct. 17, 1994 and JP 06 191967, Jul. 12, 1994.
Patent Abstracts of Japan, vol. 008, No. 178 (C-238) Aug. 16, 1984 and JP 59 075971, Apr. 28, 1984.
Patent Abstracts of Japan, vol. 0154, No. 21 (C-0878) Oct. 25, 1991 and JP 03 174041, Jul. 29, 1991.
Database WPI, Section Ch, Week 200419, XP002288998 and JP 2002 194693, Jul. 10, 2002.
Database WPI, Section Ch, Week 200165, XP 002288999 and JP 2001 214400, Aug. 7, 2001.
Bolboacă et al, Bulletin USAMV-CN 2007, 63-64, 311-316.
Excerpt from Kirk-Othmer Encyclopedia of Chemical Technology, 1978, 12, 81, second full paragraph.

* cited by examiner

MIXING OF A PROTEIN HYDROLYSATE DERIVED FROM KERATIN-CONTAINING MATERIAL IN THE WET-END OF A PAPERMAKING PROCESS

This application is the US national phase of international application PCT/NL2005/000120 filed Feb. 18, 2005 which designated the U.S. and claims priority to EP 04075539.9 filed Feb. 19, 2004, the entire content of each of which is hereby incorporated by reference.

BACKGROUND OF THE INVENTION

The present invention relates to the use of protein hydrolysate derived from keratin-containing material in the wet-end of a papermaking process, a process for preparing a paper product, and paper pulp and paper products comprising such a protein hydrolysate additive.

In the papermaking industry a wide variety of additives is applied to improve properties of the finished paper product. Such properties include, for instance, printability, wet/dry strength, softness and wetting properties. Generally, the amounts of additives to be used need to be carefully controlled because most of these additives are expensive chemicals.

BRIEF SUMMARY OF THE INVENTION

Object of the present invention is to provide a new class of cheap additives, which can attractively be used in the production of paper products.

Surprisingly, it has now been found that protein hydrolysate derived from keratin-containing material can attractively be used as a paper product additive with high retention.

Accordingly, the present invention relates to the use of a protein hydrolysate derived from keratin-containing material as an additive in the wet-end of a papermaking process.

The present invention enables the production of very high quality paper products in a very cost-effective manner. The paper products obtained in accordance with the present invention display excellent quality properties in terms of strength and volume per mass.

It will be appreciated that with the term wet-end is meant the stage of the papermaking process prior to the dry-end stage (the stage where the paper product to be made is dried).

BRIEF DESCRIPTION OF THE SEVERAL VIEWS OF THE DRAWING(S)

DETAILED DESCRIPTION OF THE INVENTION

Figure 1:
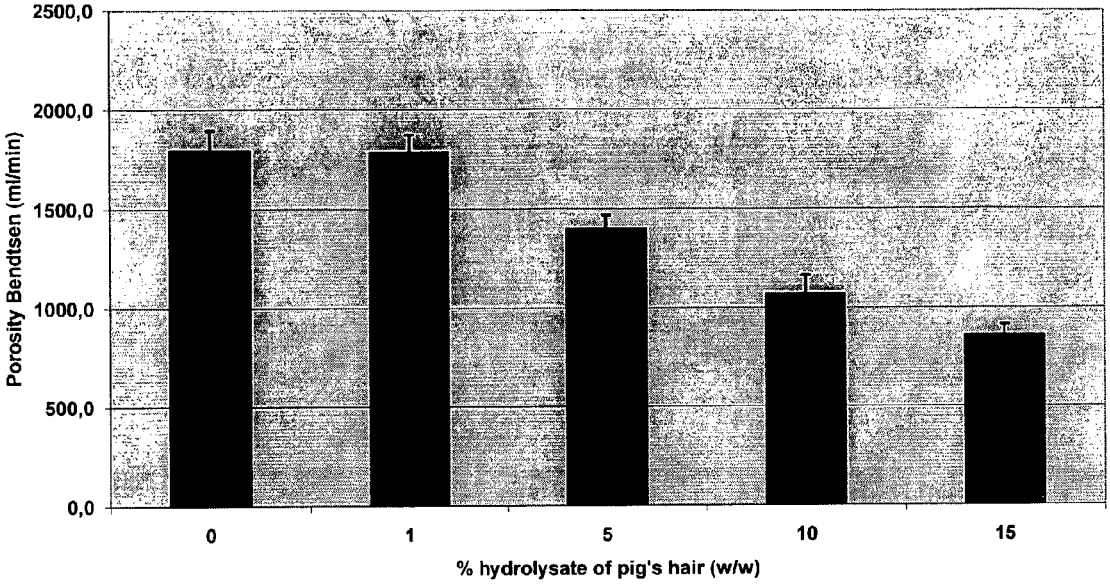
FIG. 1 shows the Porosity of paper as compared to varying hydrolysate levels.

The protein hydrolysate to be used in accordance with the present invention can be derived from a wide variety of keratin-containing materials. The keratin-containing materials can suitably be derived from mammals and/or birds. Suitable keratin-containing materials from which the protein hydrolysate can be derived include mammalian hair, animal hooves, claws, horns, and feathers. The protein hydrolysate is preferably derived from mammalian hair and/or feathers. More preferably, the protein hydrolysate is derived from mammalian hair, in particular from livestock, and more particularly from pigs and chicken feathers.

The protein hydrolysate to be used in accordance with the present invention can suitable be prepared by subjecting the keratin-containing material to an oxidation treatment in which the keratin-containing material is contacted with a solution, which comprises a bleaching agent. The solution to be used in the oxidation treatment has been made alkaline (above pH 7) or acidic (below pH 7). Preferably, the solution has been made alkaline by the addition of NaOH, KOH and/or $NH_4OH$ or acidic by the addition of one or more (organic) acid(s). A wide variety of (organic) acids can be used, including acetic acid and formic acid.

The pH value of the alkaline solution to be used in step (a) is preferably in the range of from 9-13, more preferably in the range of from 10-12. The pH value of the acidic solution is preferably in the range of from 3-7, more preferably in the range of from 4-6.

Suitable bleaching agents include organic and inorganic peroxides. Preferably, use is made of a bleaching agent selected from the group of hypohalides, perborates, percarbonates, organic peroxides, or hydrogen peroxide. More preferably, the bleaching agent comprises hydrogen peroxide. One single bleaching agent or a mixture of bleaching agents can suitably be applied in the alkaline or acidic solution. In the alkaline solution preferably inorganic peroxides are used, whereas in the acidic solution preferably organic peroxides are used. Suitably, the bleaching agent is used in an amount in the range of from 0.1% (w/w) to 40% (w/w), preferably in the range of from 0.3% (w/w) to 30% (w/w), based on total alkaline or acidic solution.

In the oxidation treatment the keratin-containing material can suitably be contacted with the alkaline or acidic solution over a period of time in the range of from 5 minutes to 16 hours, preferably in the range of from 15 minutes to 10 hours. The temperature to be applied in the oxidation treatment can suitably be in the range of from room temperature to 100° C., preferably in the range of from 30° C. to 80° C.

The keratin-containing material can be one type of keratin-containing material or it can be a mixture of different types of keratin-containing materials.

The keratin-containing material to be subjected to the oxidation treatment is preferably first subjected to a washing step in which soluble components, such as for instance blood, urine remnants and other animal components, are removed from the keratin-containing material before the keratin-containing material is subjected to the oxidation step. The protein hydrolysate obtained in the oxidation treatment and contained in the solution can subsequently be recovered by separating it from the remaining keratin-containing material. This can be established by means of known techniques. For this purpose use can, for instance, be made of a conventional filtering system. In this way a solution of the protein hydrolysate can be obtained. In order to recover the protein hydrolysate from the protein hydrolysate solution so obtained, the pH value of the solution can suitably be adjusted so as to allow the protein hydrolysate to precipitate, after which the protein hydrolysate precipitate can be recovered by methods known per se. The pH of the solution is preferably adjusted so as to be in the range of from 1 to 5, more preferably to be in the range of 2 to 4. The pH adjustment can be established by adding in a controlled manner, for instance by way of titration, an organic and/or inorganic acid to the solution. Suitable acids include hydrochloric acid, sulphuric acid, acetic and formic acid, and the like.

Suitably, the pH adjustment can be carried out over a period of time in the range of from 5 minutes to 10 hours, preferably in the range of from 20 minutes to 8 hours The temperature to be applied during the pH adjustment can suitably be in the range of from 15° C. to 100° C., preferably in the range of from 25° C. to 70° C.

Suitably, the protein hydrolysate precipitate obtained can be dissolved in a liquid medium to obtain a solution, which can be used as a paper product additive. Such a liquid medium suitably includes virgin and/or recycled cellulose fibres and/or known additives used in the wet-end of the paper process. Preferably, water or recycled water is used as the liquid medium. To the protein hydrolysate solution so obtained one or more other paper product additives can be added before the solution is used to produce a paper product. These other additives may contribute to different properties of the paper product to be obtained. The concentration of the protein hydrolysate will suitably be in the range of from 0.1% (w/w) to 50% (w/w), based on total fibre weight. Preferably, the concentration of the protein hydrolysate is in the range of from 0.3% (w/w) to 40% (w/w), based on total fibre weight.

Alternatively, the protein hydrolysate precipitate can as such be added to a solution containing one or more other additives to be used in the manufacturing of a paper product. In another suitable embodiment the protein hydrolysate precipitate is added directly to the paper pulp where after it is thoroughly mixed with other paper pulp components.

Preferably, the protein hydrolysate additive is used in the form of a solution.

The present invention also relates to a process for preparing a paper pulp comprising mixing in the wet-end a protein hydrolysate derived from keratin-containing material with virgin and/or recycled cellulose fibres, and recovering the paper pulp so obtained.

The present invention also relates to paper pulp obtainable by such a process. Suitably, such paper pulp comprises protein hydrolysate derived from keratin-containing material in an amount in the range of from of from 0.1 to 50 wt. %, based on total paper pulp. Preferably, such paper pulp comprises protein hydrolysate derived from keratin-containing material in an amount in the range of from 0.3 to 40 wt. %, based on total paper pulp.

The present invention further relates to a process for preparing a paper product comprising mixing the wet-end of a papermaking process a protein hydrolysate derived from keratin-containing material with virgin and/or recycled cellulose fibres, dewatering the mixture so obtained, pressing the dewatered material, drying the pressed material, and recovering the paper product so obtained.

Further, the present invention also relates to a paper product obtainable by such a process. Suitably, such paper product comprises protein hydrolysate derived from keratin-containing material in an amount in the range of from 0.1 to 50 wt. %, based on total paper product. Preferably, such paper product comprises protein hydrolysate derived from keratin-containing material in an amount in the range of from 0.3 to 40 wt. %, based on total paper product.

In the context of the present invention the term "paper product" is meant to include all sorts of papers, such as printing paper, tissue/hygiene, newspaper, office paper, specialties, but also materials such as cardboard, folding board, box board, undulated board, corrugated board, and 3D board and the like.

EXAMPLES

Preparation of Protein Hydrolysate.

To a mixture of 250 grams of hair was added 9 litres of water and subsequently the pH of the mixture was brought to a level suitable for bleaching. Then the temperature of the mixture was raised to 65-70° C. and 200 ml of a 30% (w/w) solution of hydrogen peroxide (pH 11) or 60 ml of a 32% (w/w) of peracetic acid (pH 5) was added. The mixture was then stirred for 16 hours after which the hydrolysate was isolated by lowering the pH of the reaction mixture to 3. Once the precipitate was formed it was collected through filtration and dried at 70° C. After drying, the obtained product may optionally be grinded into a powder.

Evaluation of the Protein Hydrolysate

The hydrolysate (0, 1, 5, 10, 15% (w/w)) was mixed with virgin cellulose fibres from Eucalyptus in such a way that for each mixture a constant weight of cellulose fibres was obtained. Also sheets were using only the virgin Eucalyptus cellulose fibres for comparison and evaluation results are depicted as 0% (w/w). The sheets were obtained by using a FRET (Formation and Retention Tester), using a vacuum of 0.5 bar. The sheets were dried at 100° C., using a Rapid Köthen drying cell. For each mixture three sheets were made.

From each mixture the paper properties were determined

Retention of the Protein Hydrolysate

Hand sheets were made on a Rapid Köthen (RK) sheet former as described above, and 360 mg of the keratine hydrolysate were added to the reservoir of the RK containing the fibre mixture (about 5 gram). Afterwards the filtrate (7 litres) was analysed according to the method of Bradfort on the protein content. It was measured that 0.722 mg/l was left in the filtrate. From this data it can be concluded that no less than 98.6% of the keratine hydrolysate was retained on the fibre.

Volume Per Mass ($cm^3$/gram):

The volume per mass was calculated by dividing the thickness of the sheet by weight per $m^2$. Table 1 gives the results of the different sheets The volume per mass was reduced with increase of % protein hydrolysate. It seems that the protein hydrolysate was able to fill the pores formed by the cellulose fibre web.

TABLE 1

Volume per mass of sheets

| % Hydrolysate added (w/w) | Volume per mass ($cm^3$/g) |
|---|---|
| 0 | 1.55 |
| 1 | 1.53 |
| 5 | 1.49 |
| 10 | 1.46 |
| 15 | 1.47 |

Porosity:

The effect of the addition of protein hydrolysate is depicted in FIG. 1. With increase of the % added protein hydrolysate the porosity of the sheets decreased. The effect is clearly visible starting from 5% (w/w) added protein hydrolysate.

Figure 2:
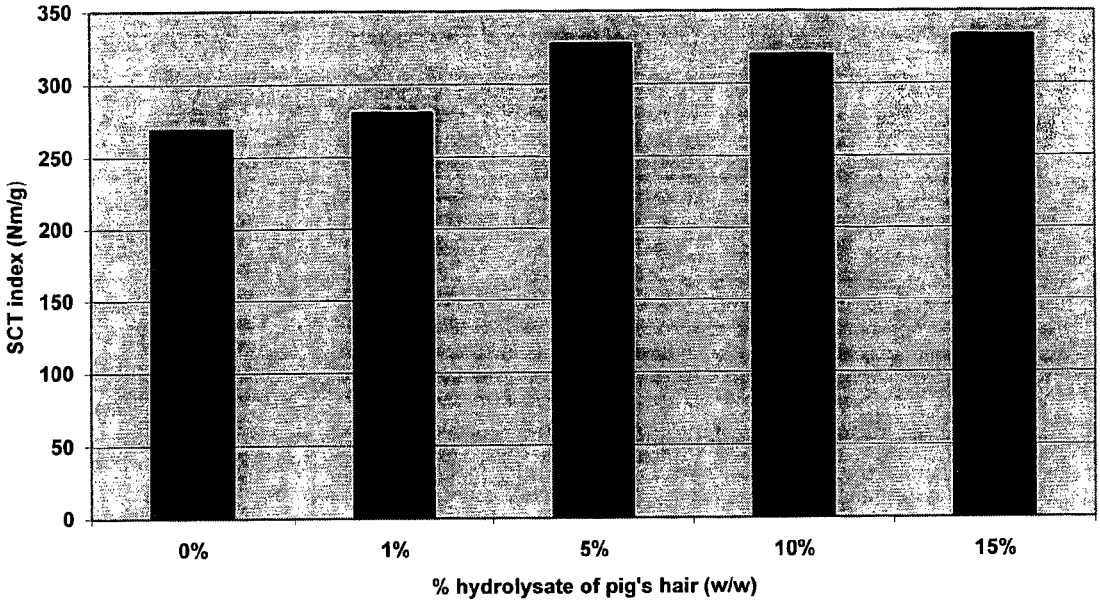
FIG. 2 shows the SCT index of paper as compared to varying hydrolysate levels.

Short Compression Test:

The influence of protein hydrolysate as additive in cellulose pulp on the SCT index is depicted in FIG. 2. The added protein hydrolysate has a positive influence on the short compression test index.

Figure 3:
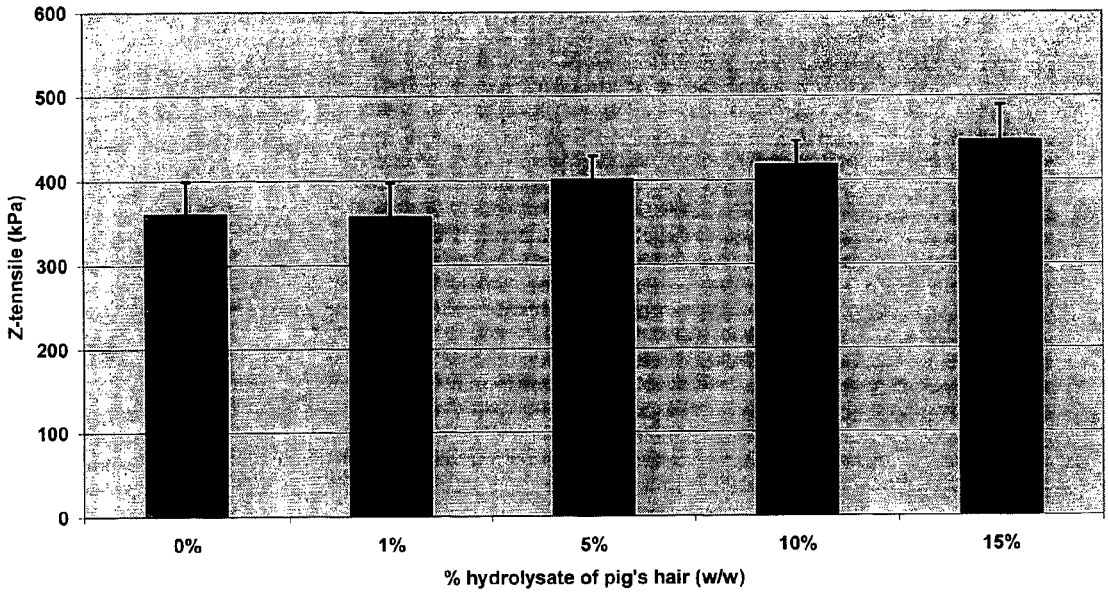
FIG. 3 shows the Z-tensile of paper as compared to varying hydrolysate levels.

Z-Directional Tensile:

The influence of protein hydrolysate on the Z-directional tensile is depicted in FIG. 3. FIG. 3 shows that increased addition of protein hydrolysate in cellulose fibre has a positive influence on the fibre interaction.

Figure 4:
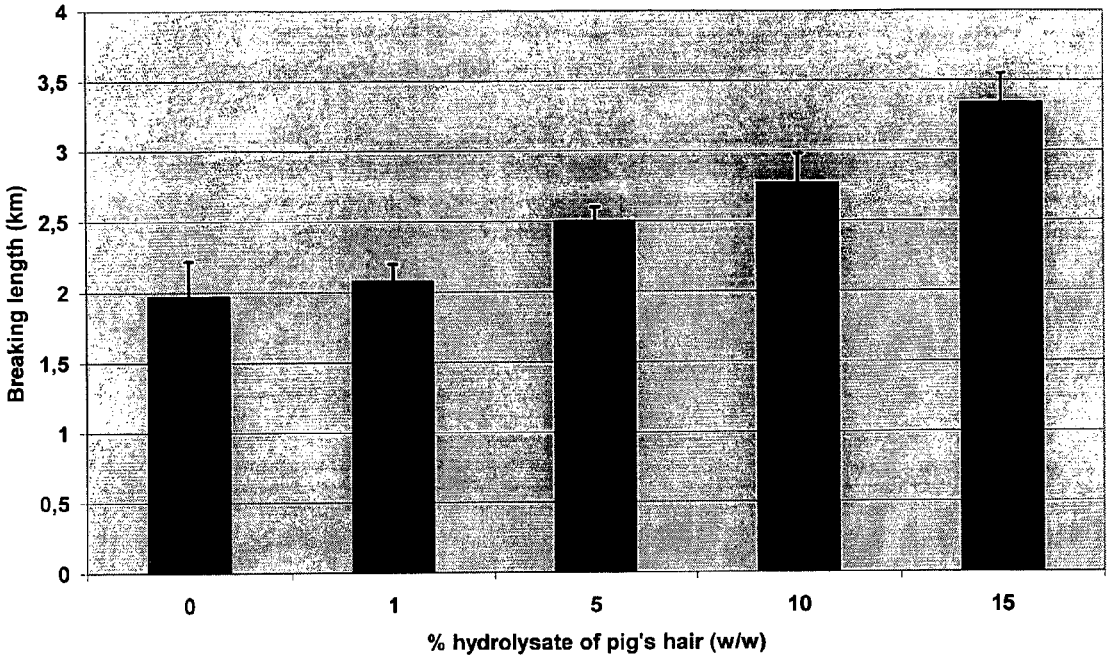
FIG. 4 shows the Breaking length of paper as compared to varying hydrolvsate levels.

Tensile Index:

This parameter is measured to evaluate the force at break and gives an indication of the length of the paper needed before it breaks. FIG. 4 shows the results when part of the cellulose fibre is replaced by protein hydrolysate. There is a sharp increase on the length of break with increased weight percent of protein hydrolysate implying a stronger paper. This effect coincides with earlier observed improved fibre-fibre interaction.

Figure 5:
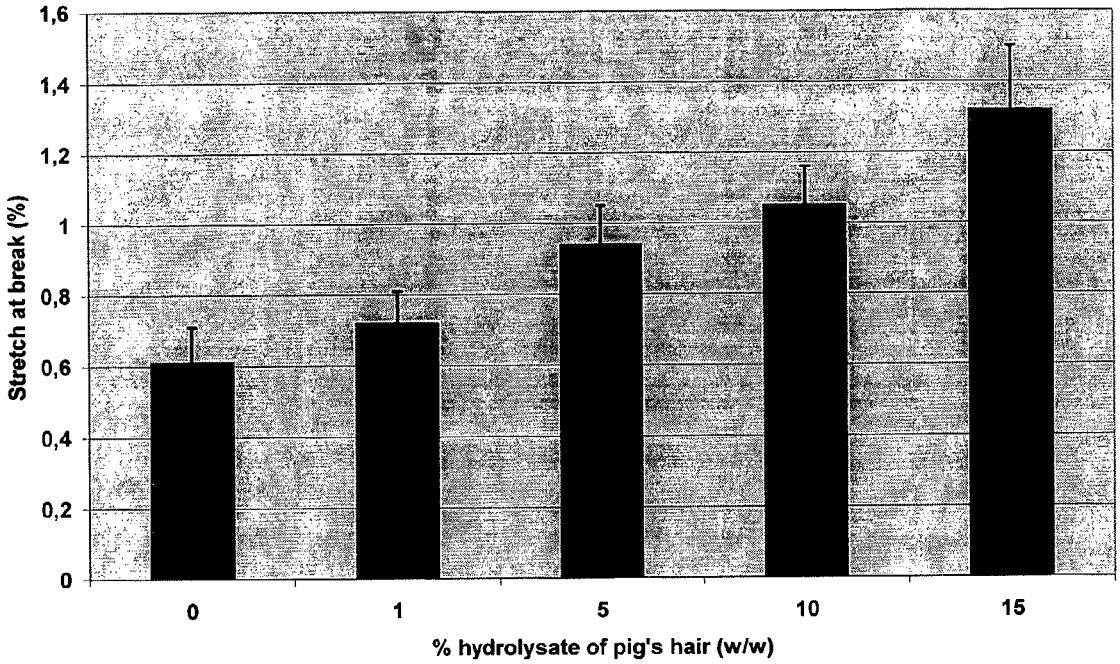
FIG. 5 shows the Stretch at break of paper as compared to varying hydrolysate levels.

Stretch at Break:

This parameter gives an indication of the amount of stretch of the paper sheet before it breaks. The results are depicted in FIG. 5. The results fit well within the earlier results presented in FIGS. 3 and 4. An increase in weight of protein hydrolysate also gives an increase in stretch at break.

The invention claimed is:

1. A process comprising contacting a keratin-containing material with a solution which comprises a bleaching agent at an acidic pH ranging from 3-6 to produce a keratin protein hydrolysate and adding said keratin protein hydrolysate into the wet-end of a papermaking process.

2. The process according to claim 1, wherein the protein hydrolysate is derived from mammalian hair and/or feathers.

3. The process according to claim 2, wherein the protein hydrolysate is derived from mammalian hair.

4. The process according to claim 2, wherein the protein hydrolysate is derived from feathers.

5. The process according to claim 3, wherein the mammalian hair is derived from livestock.

6. The process according to claim 4, wherein the feathers are derived from chickens.

7. The process according to claim 5, wherein the mammalian hair is derived from pigs.

8. A process for preparing a paper pulp comprising mixing in the wet-end of a papermaking process a keratin protein hydrolysate with virgin and/or recycled cellulose fibers and recovering the paper pulp so obtained wherein said keratin protein hydrolysate is derived from keratin-containing material prepared by contacting the keratin-containing material with a solution which comprises a bleaching agent at an acidic pH ranging from 3-6.

9. Process for preparing a paper product comprising mixing in the wet-end of a papermaking process a keratin protein hydrolysate with virgin and/or recycled cellulose fibers, dewatering the mixture so obtained, pressing the dewatered material, drying the pressed material, and recovering the paper product so obtained wherein said keratin protein hydrolysate is derived from keratin-containing material prepared by contacting the keratin-containing material with a solution which comprises a bleaching agent at an acidic pH ranging from 3-6.

* * * * *